US011399677B2

(12) United States Patent
Sun

(10) Patent No.: US 11,399,677 B2
(45) Date of Patent: Aug. 2, 2022

(54) CLEANER

(71) Applicant: LG ELECTRONICS INC., Seoul (KR)

(72) Inventor: Changhwa Sun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 296 days.

(21) Appl. No.: 15/867,464

(22) Filed: Jan. 10, 2018

(65) Prior Publication Data

US 2018/0199774 A1 Jul. 19, 2018

(30) Foreign Application Priority Data

Jan. 19, 2017 (KR) ..... 10-2017-0009317

(51) Int. Cl.
*A47L 9/04* (2006.01)

(52) U.S. Cl.
CPC ..... *A47L 9/0488* (2013.01); *A47L 9/0477* (2013.01); *A47L 2201/04* (2013.01)

(58) Field of Classification Search
CPC .... A47L 9/0666; A47L 9/0477; A47L 9/0488; A47L 9/0633; A47L 9/0653; A47L 9/066
USPC ..... 15/418, 378
See application file for complete search history.

(56) References Cited

U.S. PATENT DOCUMENTS 2,181,594 A * 11/1939 Bjorkman ..... A47L 9/02 15/418
3,100,907 A * 8/1963 Schwertl ..... B44D 3/162 15/377
4,864,682 A * 9/1989 Bewley, Jr. ..... A47L 5/34 15/371

(Continued)

FOREIGN PATENT DOCUMENTS

EP 2116165 A2 * 11/2009 ..... A47L 9/02
JP 2003-525079 8/2003

(Continued)

OTHER PUBLICATIONS

International Search Report dated Jun. 26, 2018 issued in Application No. PCT/KR2017/014327.

(Continued)

*Primary Examiner* — Michael D Jennings
*Assistant Examiner* — Aaron R McConnell
(74) *Attorney, Agent, or Firm* — Ked & Associates, LLP

(57) ABSTRACT

A cleaner according to the present invention includes a cleaner main body, and a suction unit provided with a nozzle portion configured to suck air containing foreign substances on a floor into the cleaner main body, and a brush assembly detachably mounted on the nozzle portion, wherein the brush assembly includes a frame coupled to the nozzle portion and provided with an opening that is open toward the front and positioned adjacent to the floor, a brush rotation bar accommodated in the frame and having at least one end portion rotatably supported on the frame, and a variable (Continued)

shutter rotatably mounted on the frame, and configured to close a part of the opening by being rotated by pressing force upon being brought into contact with the floor, whereby air suction force can be varied to correspond to a state of the floor, thereby improving cleaning performance.

20 Claims, 4 Drawing Sheets

(56) References Cited

U.S. PATENT DOCUMENTS

| | | | | |
|---|---|---|---|---|
| 6,134,745 | A * | 10/2000 | Worwag | A47L 9/0411 15/355 |
| 2013/0145577 | A1* | 6/2013 | Davidshofer | A47L 5/30 15/383 |
| 2013/0174373 | A1 | 7/2013 | Genn et al. | |
| 2015/0059123 | A1* | 3/2015 | Kasper | A47L 9/064 15/383 |
| 2016/0256024 | A1 | 9/2016 | Kettle Aiers et al. | |

FOREIGN PATENT DOCUMENTS

| | | |
|---|---|---|
| JP | 3849376 | 11/2006 |
| JP | 4607683 | 1/2011 |
| KR | 20-0150470 | 7/1999 |
| KR | 10-1999-0073729 | 10/1999 |
| KR | 10-0809737 | 3/2008 |
| KR | 10-0809740 | 3/2008 |
| KR | 10-2016-0116047 | 10/2016 |

OTHER PUBLICATIONS

Korean Notice of Allowance Action dated Nov. 30, 2018 issued in Application No. 10-2017-0009317.

* cited by examiner

CLEANER

CROSS-REFERENCE TO RELATED APPLICATION

Pursuant to 35 USC § 119 (a), this application claims the benefit of an earlier filing date and priority to Korean Application No. 10-2017-0009317, filed on Jan. 19, 2017, the contents of which are incorporated by reference herein in its entirety.

1. FIELD OF THE INVENTION

The present invention relates to a cleaner for removing dust on a floor by using a suction flow.

2. BACKGROUND OF THE INVENTION

Generally, a cleaner includes a vacuum cleaner in which a fan is rotated by a driving motor to generate a suction flow so as to suck dust. In recent years, as an application field of robots is expanded, a robot cleaner has been produced which is configured to autonomously travel within a predetermined space to suck dust on a floor or mop the floor.

A cleaner which is operated by a user's manipulation or autonomously travels is provided with a brush rotating body for effectively sucking dust on a floor (bottom surface). Specifically, the brush rotating body is rotated by a separate driving motor or the like, or rotated by rolling friction with respect to the floor. Further, the brush rotating body is provided with a brush having a plurality of bristles on an outer circumference of a rotating body thereof, and the brush sweeps dust on the floor toward a suction port to induce the suction of the dust.

The brush rotating body is mounted on a suction unit for sucking air. The suction unit is configured to suck dust and air into the cleaner, and generally sucks dust and air of the floor from a lower surface of the suction unit on which the brush rotating body is mounted.

On the other hand, when the cleaner is placed on the floor, there is a spacing between the suction unit and the floor, and this spacing becomes an air flow path through which air is sucked into the lower surface of the suction unit. At this time, as the spacing between the lower surface of the suction unit and the floor is smaller, a sectional area of the air flow path is more reduced and a flow rate and pressure of the air sucked into the cleaner may further be increased. However, when the spacing between the lower surface of the suction unit and the floor is small, relatively large foreign materials fail to pass through the suction unit, thereby deteriorating cleaning performance.

An optimal value of the sectional area of the air flow path may vary depending on a condition of the floor. For example, when the cleaner runs on a rug or the like laid on the floor, larger air suction force may be required rather than that for a normal floor.

Therefore, in order to improve the cleaning performance, it is necessary to develop a structure in which the sectional area of the air flow path of the lower surface of the suction unit can be varied according to the state of the floor. Particularly, there is a need for a development of a structure in which the sectional area can be varied accurately according to the state of the floor even without a user's manipulation, so as to be suitable for a robot cleaner that autonomously travels.

On the other hand, when the brush rotating body is placed on the floor, a squeegee for supporting foreign materials which are swept by the brush rotating body may be disposed at the rear of the brush rotating body. However, the squeegee may act as large resistance when the cleaner is moved in a space where a carpet or the like is laid on the floor. When running resistance is increased by the squeegee, there is a problem that a lot of force is consumed in the user's operation. Furthermore, it causes a problem because the robot cleaner is likely to actually travel at a shorter distance than a distance recognized by a controller or not to move at all. Patent Document 1 discloses a configuration in which a structure for collecting foreign materials, provided on a lower surface of the robot cleaner, can be varied on a floor with a carpet or the like thereon.

In consideration of this related art technique, an integrated structure in which the squeegee is varied according to the state of the floor and the sectional area of the air flow path for the air suction is varied may be realized.

(Patent Document 1) KR10-0809737 B1 (Feb. 26, 2008)

SUMMARY OF THE INVENTION

A first aspect of the present invention is to provide a cleaner, capable of varying suction force according to a state of a floor (or a bottom surface), by employing a brush assembly that is rotated by contact with the floor to vary a sectional area of a flow path through which air is introduced.

A second aspect of the present invention is to provide a cleaner, capable of attenuating running resistance, by employing a brush assembly that is rotated by contact with a floor to reduce a sectional area of an air flow path and upwardly move a squeegee structure supporting foreign materials.

In order to achieve the first aspect of the present invention, there is provided with a cleaner, including a cleaner main body, and a suction unit provided with a nozzle portion configured to suck air containing foreign substances on a floor into the cleaner main body, and a brush assembly detachably mounted on the nozzle portion. The brush assembly may include a frame coupled to the nozzle portion and provided with an opening that is open toward the front and positioned adjacent to the floor, a brush rotation bar accommodated in the frame and having at least one end portion rotatably supported on the frame, and a variable shutter rotatably mounted on the frame, and configured to close a part of the opening by being rotated by pressing force upon being brought into contact with the floor.

In this case, the variable shutter may include hinge portions rotatably mounted on both ends of the frame, a shutter portion connected to the front of the hinge portions and configured to close a part of the opening by being rotated downward in response to the rotation of the hinge portions, and a pressing portion connected to the rear of the hinge portions and configured to transfer rotational force to the hinge portions by being rotated upward in response to the contact with the floor.

According to another aspect of the present invention, there is provided a cleaner, including a cleaner main body, and a suction unit provided with a nozzle portion configured to suck air containing foreign substances on a floor into the cleaner main body, and a brush assembly detachably mounted on the nozzle portion. The brush assembly may include a frame coupled to the nozzle portion and provided with an opening that is open toward the front and positioned adjacent to the floor, a brush rotation bar accommodated in the frame and having at least one end portion rotatably supported on the frame, and a variable shutter rotatably mounted on the frame, and configured to close a part of the opening by being rotated by pressing force upon being brought into contact with the floor. The variable shutter may include a squeegee member rotated upward by being brought into contact with the floor and extending in parallel with the brush rotation bar so as to restrict movement of the foreign substances at the rear of the brush rotation bar.

The frame may include support portions configured to rotatably support the hinge portions, and an extending portion connected to the support portions and extending in parallel with the brush rotation bar so as to form the opening on the floor.

Further, the support portion may be provided with a detachable portion that is opened upward and elastically deformable when the hinge portion is slid.

The hinge portion may be formed in a shape of surrounding the brush rotation bar so as to be slid on an outer circumferential surface of the brush rotation bar. Accordingly, the variable shutter can be concentrically rotated with the brush rotation bar with being supported on the brush rotation bar.

In addition, the shutter portion and the pressing portion may be located to be lower than a rotation center of the hinge portion, such that the variable shutter and the brush rotation bar can be detached from each other.

The frame may be provided with an opening stopper protruding toward a rotation path of the shutter portion so as to restrict rotation of the variable shutter in a direction to open the opening.

Further, the frame may be provided with a closing stopper protruding toward a rotation path of the pressing portion so as to restrict rotation of the variable shutter in a direction to close the opening.

The rotation of the variable shutter can be restricted at a preset position by the opening stopper and the closing stopper.

The pressing portion may be provided with an elastic member elastically deformable by being brought into contact with the closing stopper so as to generate elastic force in a direction to be separated from the closing stopper. Therefore, restoring force can be applied in a direction of increasing an area of the opening.

In this instance, the pressing portion may be provided with a squeegee member extending in parallel with the brush rotation bar so as to restrict movement of the foreign substances at the rear of the brush rotation bar, and elastically deformable by being brought into contact with the closing stopper.

The pressing portion may be provided with a mass reinforcing portion configured to apply a torque for rotating the variable shutter in a direction to open the opening. Accordingly, reinforcing force is applied in a direction of increasing the area of the opening.

The pressing portion is provided with a squeegee member extending in parallel with the brush rotation bar so as to restrict the movement of the foreign substances at the rear of the brush rotation bar, and inserted into the mass reinforcing portion.

According to the present invention constituted as described above, the following effects can be obtained.

First, a cleaner of the present invention may include a variable shutter that closes an opening by being rotated in response to a contact with a floor, which may result in an increase in air suction force in a section where the brush assembly is located relatively close to the floor. Since the variable shutter varies the opening when the cleaner of the present invention runs on a floor with a carpet or the like laid thereon, suction force can be changed even without recognition or separate operation by a user or controller.

Second, the variable shutter may include a squeegee member provided on the pressing portion that receives rotational force by the contact with the floor, so that the squeegee member can be moved upward together with the pressing portion on the floor with the carpet or the like laid thereon. Accordingly, running resistance due to the squeegee member can also be reduced, and thus a brush assembly structure that is optimized for the floor with the carpet or the like laid thereon can be achieved.

Further, the support portion of the frame may be provided with a detachable portion that is elastically deformed so as to detachably accommodate the hinge portion of the variable shutter, which may facilitate cleanliness and replacement of the variable shutter according to the present invention.

Meanwhile, since the hinge portion of the variable shutter is slid and rotated on an outer circumferential surface of a brush rotation bar, the variable shutter can be rotated without an addition of a separate rotating shaft structure.

In addition, since a shutter portion and a pressing portion of the variable shutter are disposed on one side with respect to a rotation center of the hinge portion, the brush rotation bar and the variable shutter can be easily detached from each other, which may facilitate cleaning or replacement of each component.

On the other hand, the frame may be provided with an opening stopper and a closing stopper to stop the variable shutter, so that opening and closing regions of the opening can be accurately set.

At this time, the pressing portion may be provided with an elastic member to generate elastic force by being brought into contact with the closing stopper, so that the variable shutter can be quickly returned to a position to open the opening when there is no pressing by the floor.

Furthermore, since a squeegee member provided on the pressing portion to support foreign substances is configured to perform a role of the elastic member, a variable shutter structure can be simply realized.

On the other hand, since the pressing portion is provided with a mass reinforcing portion, restoring force can be applied to the variable shutter of the present invention in a direction to open the opening. Accordingly, when there is no pressing by the floor, the variable shutter can be quickly returned to its original position.

Further, since the squeegee member supporting the foreign substances is mounted on the mass reinforcing portion, a variable shutter structure can be simply realized.

DETAILED DESCRIPTION OF THE PREFERRED EMBODIMENT

Hereinafter, a cleaner according to the present invention will be described in detail with reference to the accompanying drawings.

In describing the present invention, if a detailed explanation for a related known function or construction is considered to unnecessarily divert the gist of the present disclosure, such explanation has been omitted but would be understood by those skilled in the art.

The accompanying drawings are used to help easily understand the technical idea of the present invention and it should be understood that the idea of the present invention is not limited by the accompanying drawings. The idea of the present disclosure should be construed to extend to any alterations, equivalents and substitutes besides the accompanying drawings.

A singular representation may include a plural representation unless it represents a definitely different meaning from the context.

Figure 1:
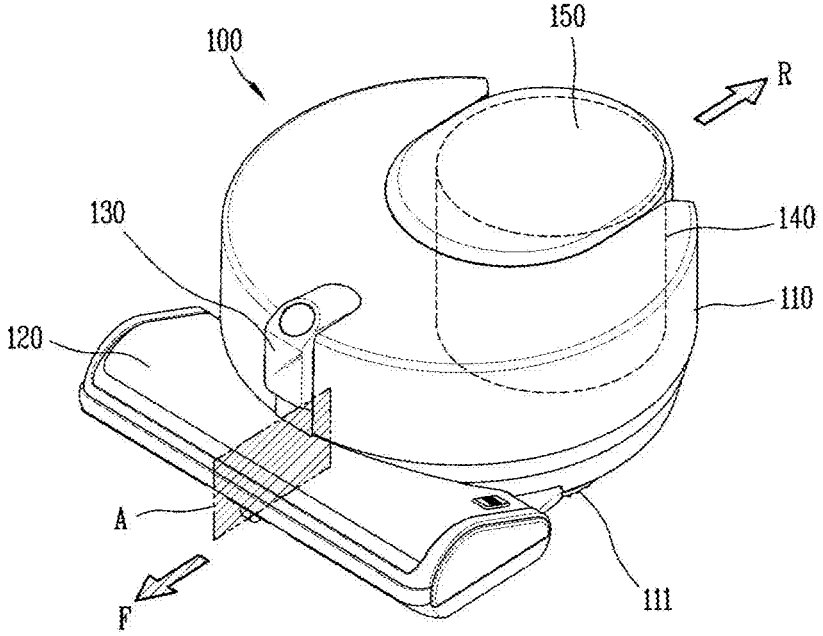
FIG. 1 is a perspective view illustrating one embodiment of a cleaner according to the present invention.
Figure 2:
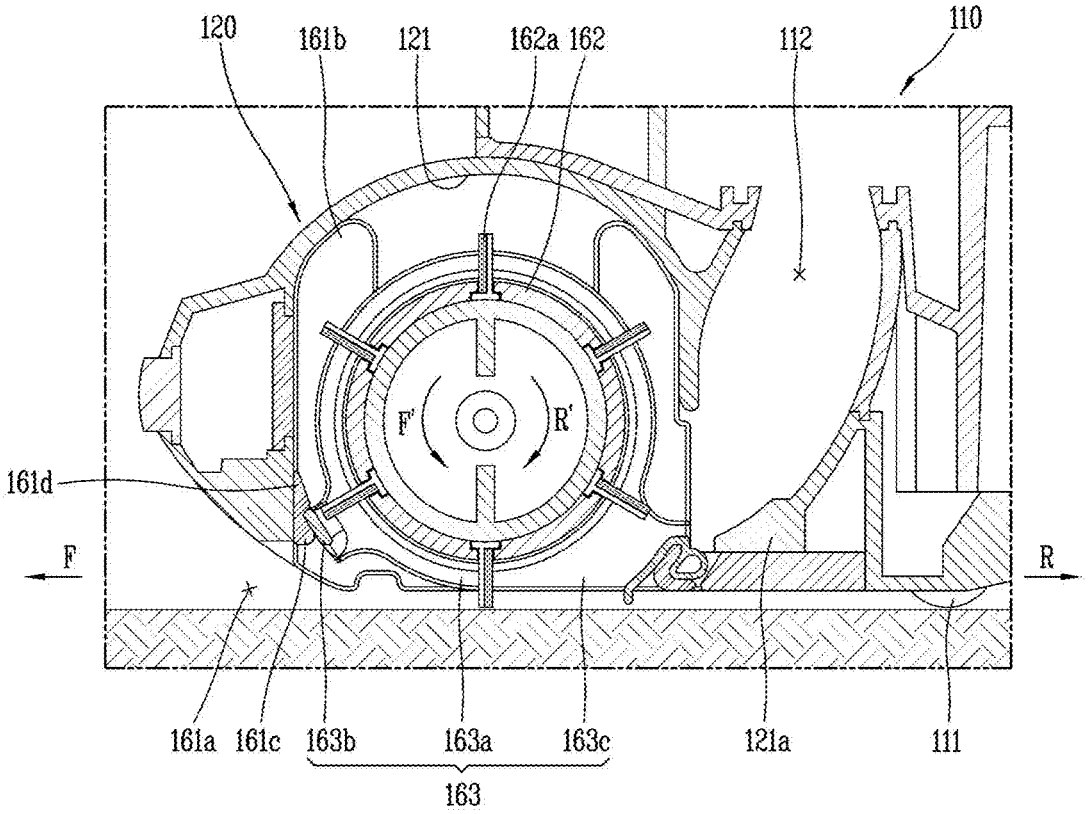
FIG. 2 is a sectional view taken along an area A illustrated in FIG. 1.

FIG. 1 is a perspective view illustrating one example of a cleaner 100 according to the present invention, and FIG. 2 is a sectional view of an area A illustrated in FIG. 1. As illustrated in FIGS. 1 and 2, a cleaner 100 according to the present invention includes a cleaner main body 110 and a suction unit 120.

The cleaner main body 110 defines appearance of the cleaner 100. As illustrated in FIG. 1, the cleaner 100 according to the present invention may be a robot cleaner that performs a function of cleaning a floor while running on a predetermined area by itself. At this time, cleaning the floor includes sucking foreign substances such as dust present on the floor or mopping the floor.

In the embodiment of the robot cleaner, the cleaner main body 110 may include a wheel unit 111 for traveling, and a controller (not illustrated) for controlling an operation of the wheel unit 111. In addition, the cleaner main body 110 may include a battery (not illustrated) for supplying power, and the battery may be detachably mounted on a lower surface of the cleaner main body 110, for example.

The suction unit 120 is connected to the cleaner main body 110 and serves to suck air containing dust. As illustrated in FIGS. 1 and 2, the suction unit 120 may be disposed in a shape protruding from one side of the cleaner main body 110. The one side where the suction unit 120 protrudes may be a front side F to which the cleaner of the present invention travels. In addition, the suction unit 120, as illustrated in FIG. 1, may have a shape protruding to both of right and left sides. The suction unit 120 may be provided with a nozzle portion 121 for sucking foreign materials together with air from a lower surface thereof facing the ground.

The cleaner 100 according to the present invention may further include a sensing unit 130. As illustrated in FIG. 1, the sensing unit 130 may be disposed to face the front side F of the cleaner main body 110 where the suction unit 120 is located. More specifically, the sensing unit 130 may be disposed on an upper side of the suction unit 120, and detect features to prevent the suction unit 120 located at the foremost side F of the cleaner 100 from bumping into an obstacle or the like.

Meanwhile, a dust container 140 may be detachably coupled to the cleaner main body 110. In this embodiment, the dust container 140 may be located at a rear side R as another side of the cleaner main body 110, or may be formed to protrude toward the rear side R of the cleaner main body 110. In addition, when the dust container 140 is mounted on the cleaner main body 110, the dust container 140 may be covered with a dust container cover 150.

According to the connection between the suction unit 120 and the dust container 140, air containing dust, which is introduced through the suction unit 120, may be guided into the dust container 140 along an intake flow path 112 within the cleaner main body 110. The dust is separated from the air while passing through a filter or cyclone of the dust container 140, and collected in the dust container 140. The separated dust is discharged from the dust container 140, and finally discharged to outside through an exhaust port via an exhaust flow path within the cleaner main body 110.

Figure 3:
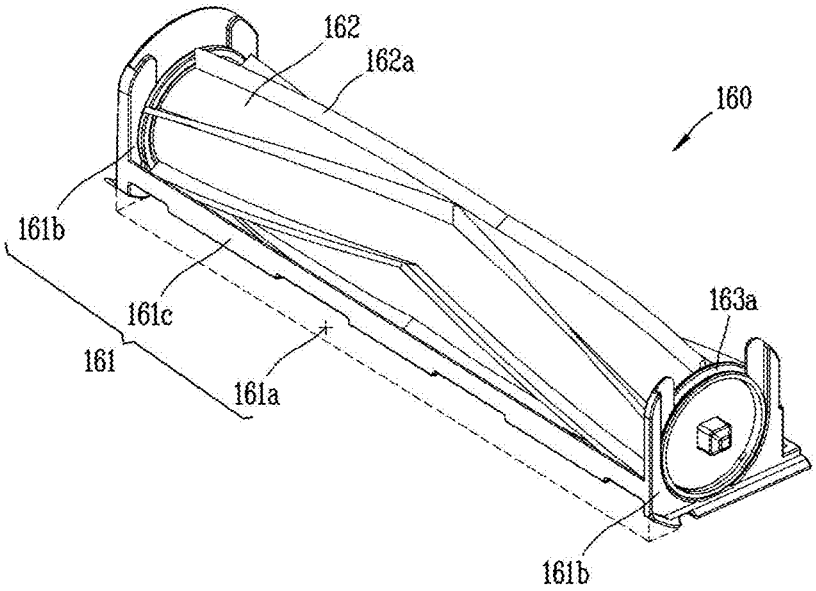
FIG. 3 is a perspective view of a brush assembly illustrated in FIG. 2.

FIG. 3 is a perspective view illustrating a brush assembly 160 according to one embodiment of the present invention. Hereinafter, the brush assembly 160 provided in the suction unit 120 of the cleaner 100 according to the present invention will be described in detail.

The brush assembly 160 is brought into contact with the floor as a space to be cleaned, and serves to help a smooth introduction of foreign substances into the suction unit 120. The brush assembly 160 may be coupled to the nozzle portion 121 formed on the lower surface of the suction unit 120, and specifically, may be detachably accommodated so as to be managed by the user in a clean state.

In case of a general vacuum cleaner, the brush assembly 160 may be rotated by rolling friction with respect to the floor according to a user's manipulation. In case of a robot cleaner, the brush assembly 121 may be automatically rotated by a separate driving motor. This embodiment illustrates the brush assembly 160 provided, for example, in the robot cleaner illustrated in FIG. 1.

The brush assembly 160 of the cleaner 100 according to the present invention includes a frame 161 and a brush rotation bar 162. The frame 161 has a shape to be insertable into the nozzle portion 121 of the suction unit 120. The brush rotation bar 162 is rotatably coupled to the frame 161. When the brush assembly 160 is mounted on the nozzle portion 121, a part of the frame 161 and a part of the brush rotation bar 162 may be positioned to face the floor.

The brush rotation bar 162 may extend to both of left and right sides so as to rotate toward the front side F. A brush portion **162*a* having a plurality of bristles formed in a predetermined pattern is formed on an outer circumferential surface of the brush rotation bar 162. The brush portion 162*a* may be brought into contact with the floor in response to the rotation of the brush rotation bar 162**.

In order for the suction unit 120 of the present invention to suck air containing foreign materials, a predetermined air flow path through which air can be sucked should be secured when the suction unit 120 is placed on the floor. Particularly, the frame 161 forms an opening **161*a***, as a part of the air flow path, which is adjacent to the floor and is open toward the front side F.

On the other hand, air suction force may be changed by a sectional area of the air flow path formed between the lower surface of the suction unit 120 and the floor. For example, even if the driving motor generates predetermined driving force for air suction, the air may fast be introduced into a narrow space as the air flow path has a smaller sectional area. That is, a flow rate of air flowing on the floor is increased, and thus force for sucking foreign materials increases.

However, when the sectional area of the air flow path is small, specifically, when a height of the opening 161*a* is low in an up and down direction, there is a problem that large foreign materials may not be sucked. The foreign materials that have failed to pass through the opening 161*a* are moved by being pushed by the suction unit 120 while remaining at the front side F of the suction unit 120, which causes the floor to be rather dirty. Particularly, for the robot cleaner as illustrated in FIG. 1, it is also difficult to instantly recognize and cope with a situation.

According to this relationship, the opening 161*a* may have an appropriate area value depending on a condition of the floor. Particularly, when the suction unit 120 is moved on a floor on which a carpet or the like is laid, the area of the opening 161*a* needs to be reduced to increase the air suction force. Considering this, the brush assembly 160 provided in the cleaner 100 of the present invention further includes a variable shutter 163 for varying the area of the opening 161*a* according to the condition of the floor.

Figure 4:
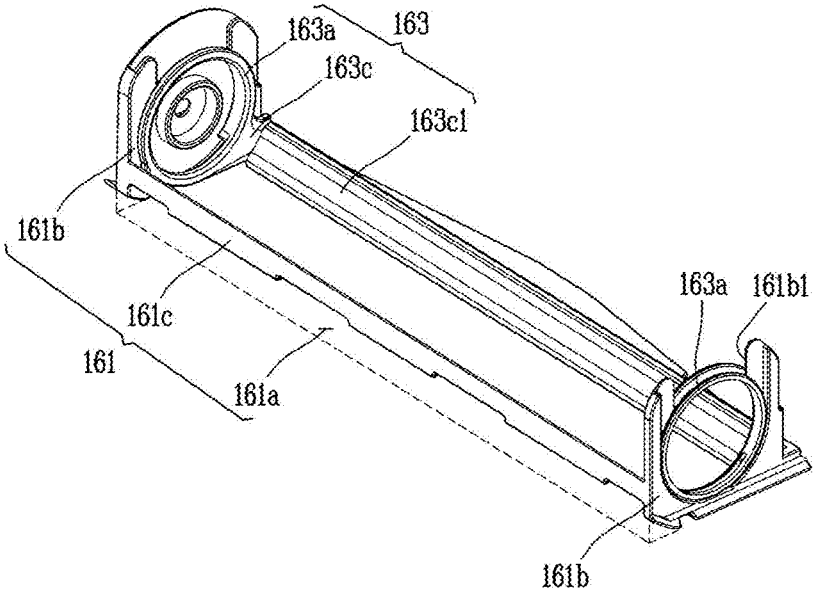
FIG. 4 is a perspective view illustrating a coupled state between a frame and a variable shutter illustrated in FIG. 3.
Figure 5:
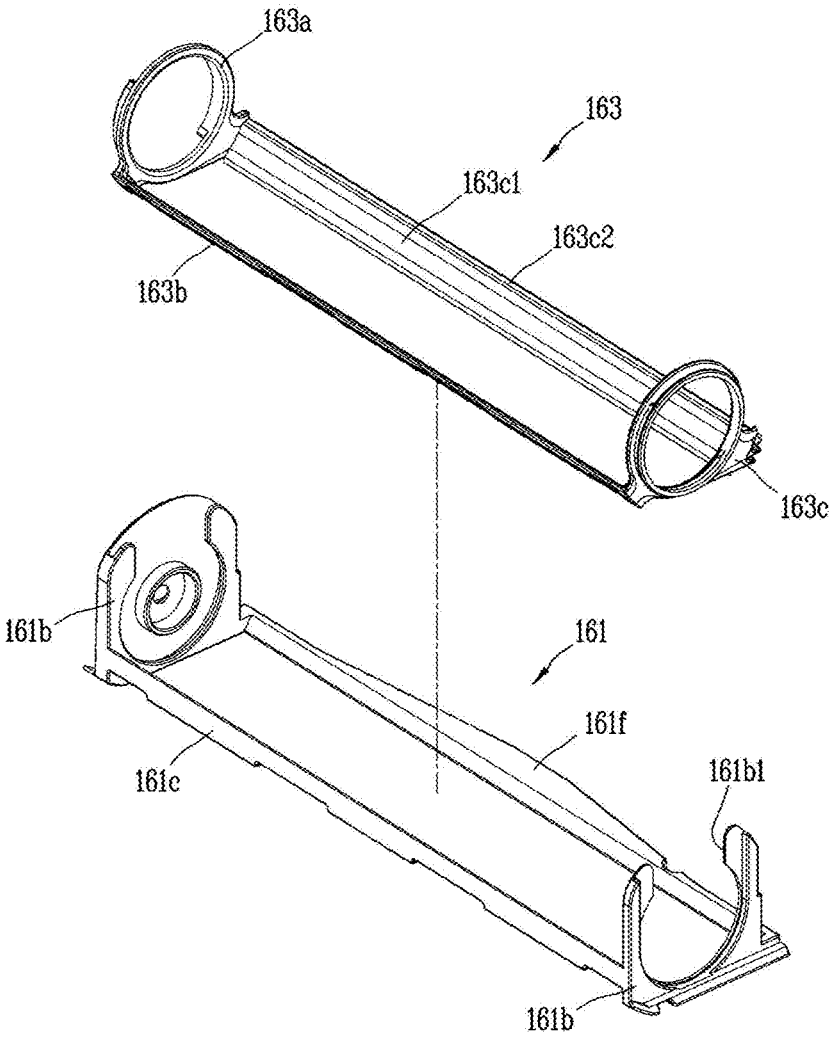
FIG. 5 is an exploded perspective view of a frame and a variable shutter illustrated in FIG. 4.

FIG. 4 is a perspective view illustrating a coupled state between the frame 161 illustrated in FIG. 3 and the variable shutter 163. FIG. 5 is an exploded perspective view of the frame 161 and the variable shutter 163 illustrated in FIG. 4.

The variable shutter 163 is configured to be rotated by pressure applied in response to being brought into contact with the floor, and is operated to close a part of the opening 161*a* by the rotation. Referring to FIGS. 3 to 5, specifically, the variable shutter 163 may include hinge portions 163*a*, a shutter portion 163*b*, and a pressing portion 163*c*.

The hinge portions 163*a* are rotatably mounted at both ends of the frame 161, and form a rotation center on which the variable shutter 163 rotates. The hinge portions 163*a* may be mounted on support portions 161*b* formed on the frame 161, and the rotation center of the variable shutter 163 may be aligned with a rotation center of the brush rotation bar 162. Detailed structural characteristics of the hinge portions 163*a* will be described later.

When the hinge portions 163*a* are rotated, the shutter portion 163*b* covers the opening 161*a* formed on the frame 161 so as to close a part of the opening 163*a*. For this purpose, the shutter portion 163*b* is made to correspond to the shape of the opening 161*a*.

The opening 161*a* may be formed by an extending portion 161*c* provided on the frame 161. The extending portion 161*c* may extend in a direction parallel to the brush rotation bar 162. In particular, the extending portion 161*c* may be upwardly spaced apart from the flat floor by a preset interval, so as to form the opening 161*a* opened toward the front side F between the floor and the extending portion 161*c*.

The shutter portion 163*b* may be configured to gradually close the opening 161*a* from an upper side when the hinge portions 163*a* are rotated forward F' by being pressed by the floor. That is, the shutter portion 163*b* may be configured to reduce the height of the opening 161*a* during the forward rotation F'. Here, the forward rotation F' indicates a direction in which the brush rotation bar 162 is rolled toward the front side F, and a rotation in an opposite direction is defined as a reverse rotation R'.

The pressing portion 163*c* is in contact with the floor so as to generate pressing force for rotating the variable shutter 163. The pressing portion 163*c* may be connected to the rear R of the hinge portions 163*a*, or in some cases, may protrude from the lower surface of the frame 161 toward the floor. As illustrated in FIGS. 4 and 5, the pressing portion 163*c* may be connected to the hinge portions 163*a*, which are disposed at both sides with being spaced apart from each other.

As a result, as illustrated in FIGS. 2 to 5, the shutter portion 163*b* and the pressing portion 163*c* may protrude from the hinge portions 163*a* in a radial direction of the rotation center formed by the hinge portions 163*a*.

Figure 6A:
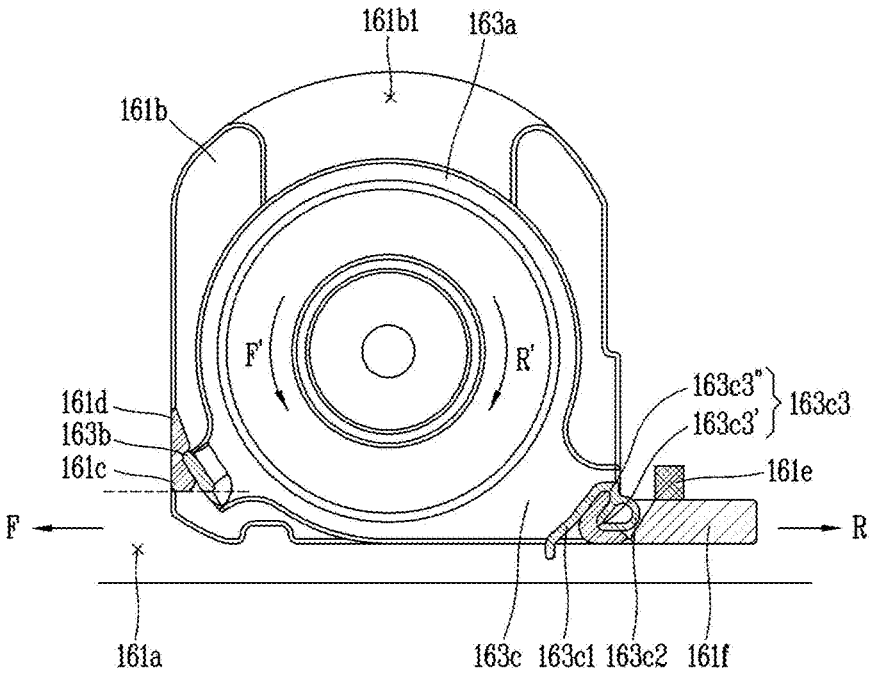
FIG. 6A is a schematic sectional view illustrating the frame and the variable shutter when the cleaner according to the present invention runs along a general floor.
Figure 6B:
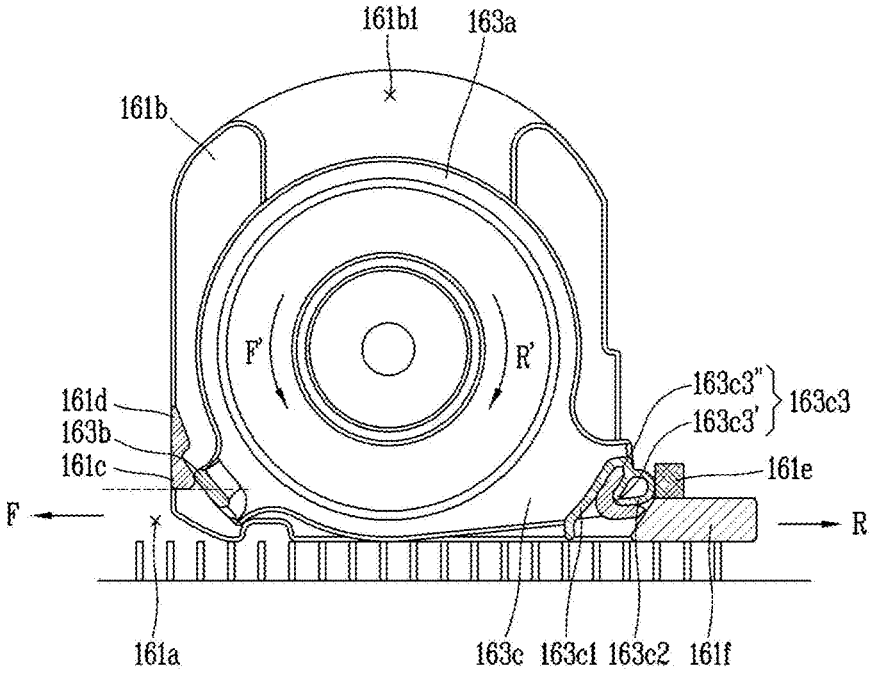
FIG. 6B is a schematic sectional view illustrating the frame and the variable shutter when the cleaner according to the present invention moves along a floor with a carpet thereon.

FIG. 6A is a conceptual sectional view illustrating the frame 161 and the variable shutter 163 when the cleaner 100 according to the present invention runs on a general floor. FIG. 6B is a sectional view illustrating the frame 161 and the variable shutter 163 when the cleaner 100 according to the present invention runs on a floor on which a carpet is laid. Referring to FIGS. 6A and 6B, it may be confirmed that the variable shutter 163 is rotated according to the state of the floor and a position of the shutter portion 163*b* is changed.

As illustrated in FIG. 6A, when the suction unit 120 of the cleaner 100 according to the present invention passes through a generally floor which is hard and flat, an interval between the extending portion 161*c* and the floor in the up and down direction corresponds to the height of the opening 161*a*. That is, the opening 161*a* is maintained in a fully opened state.

On the other hand, the floor with the carpet or the like thereon illustrated in FIG. 6B may be elastically deformable. In the robot cleaner 100 as the one example of the cleaner 100 of the present invention, the wheel unit 111 moves on the floor while supporting the main body of the cleaner 100 and the suction unit 120. At this time, a portion of the floor which is brought into contact with the wheel unit 111 is elastically deformed and locally pressed accordingly. As a result, compared to the hard floor of FIG. 6A, an upper surface of the carpet may be positioned closer to the lower surface of the frame 161 in FIG. 6B. Furthermore, the lower surface of the frame 161 and the upper surface of the carpet may be brought into contact with each other.

In the state illustrated in FIG. 6B, the pressing portion 163*c* of the variable shutter 163 may be pressed against the upper surface of the carpet. Since the pressing portion 163*c* is located at the rear R of the hinge portions 163*a*, when the pressing portion 163*c* is pressed and rotated upward, the shutter portion 163*b* positioned at the front F of the hinge portions 163*a* may be rotated downward. As the shutter portion 163*b* moves downward, the opening 161*a* is covered by the shutter portion 163*b*, and consequently the height of the opening 161*a* is lowered.

As described with reference to FIGS. 6A and 6B, the variable shutter 163 provided in the cleaner 100 of the present invention can close the opening 161*a* by the rotation caused due to the contact force with the floor. As a result, air suction force may be increased in a section where the floor is positioned relatively close to the brush assembly 160. Therefore, the present invention can more effectively perform cleaning of the floor such as the carpet requiring strong suction force.

In addition, the variable shutter 163 is configured to vary the opening 161*a* when the cleaner 100 of the present invention runs on the floor such as the carpet or the like. That is, the suction force can be varied without requirements for the user's recognition and reaction, which is a great advantage in the robot cleaner 100 as the one example of the present invention.

The pressing portion 163*c* of the variable shutter 163 provided in accordance with the present invention may include a squeegee member 163*c*1 that supports foreign substances swept to the rear side R of the brush rotation bar 162 so as to help the foreign substances to be sucked into the suction unit 120.

Specifically, the squeegee member 163*c*1 may extend in parallel with the brush rotation bar 162 at the rear side R of the brush rotation bar 162 so as to restrict the movement of the foreign substances. In other words, like the brush rotation bar 162, the squeegee member 163*c*1 may extend to both of left and right sides. And the squeegee member 163*c*1 may be positioned to be spaced apart from the general flat floor by a preset interval.

As illustrated in FIGS. 2, 6A and 6B, the squeegee member 163*c*1 of this embodiment may be formed in a shape that a part thereof is erected in an up and down direction. However, the squeegee member 163*c*1 may be formed in a thin plate shape extending to the left and right sides and to the front and rear sides and arranged in parallel with the floor.

When the squeegee member 163*c*1 is provided on the pressing portion 163*c*, a height of the squeegee member 163*c*1 may be varied in response to the rotation of the variable shutter 163. That is, as illustrated in FIGS. 6A and 6B, the squeegee member 163*c*1 may be moved upward along with the pressing portion 163*c* on the floor such as the carpet or the like. When the squeegee member 163*c*1 is moved upward, it may be possible to prevent an increase in running resistance due to friction between the squeegee member 163*c*1 and the floor such as the carpet or the like. That is, as aforementioned, as the position of the squeegee member 163*c*1 as well as the area of the opening 161*a* is changed, the suction force may be increased and the running resistance may be reduced. This may result in realizing the brush assembly 160 which is changed to be optimized for cleaning the floor with the carpet thereon.

Meanwhile, the brush assembly 160 of the cleaner 100 according to the present invention is configured to be detachable from the suction unit 120, which facilitates cleaning or replacement of the brush assembly 160 itself. In addition, in the brush assembly 160 of the present invention, the variable shutter 163, the frame 161, and the brush rotation bar 162 may be configured to be detachable, respectively, and the cleanliness and replacement of each component is also facilitated.

First, a detachable structure of the variable shutter 163 and the frame 161 will be described. As described above with reference to FIGS. 4 and 5, the frame 161 is provided with the support portions 161*b*, and the variable shutter 163 is provided with the hinge portions 163*a*. The support portions 161*b* include a detachable portion 161*b*1 so that the hinge portion 163*a* can be detached from the support portion 161*b*.

As illustrated in FIGS. 4 and 5, the detachable portion 161*b*1 may be formed on any one of the support portions 161*b* which are located with being spaced apart from each other in the left-right direction. The detachable portion 161*b*1 forms an upwardly-open space, such that the hinge portion 163*a* is slidably coupled to the detachable portion 161*b*1 in the up and down direction. The detachable portion 161*b*1 may be brought into contact with an outer circumferential surface of the hinge portion 163*a* at the front F and rear R, respectively. At this time, a spacing between the front and rear sides of the detachable portion 161*b*1 may be smaller than a diameter of the hinge portion 163*a*, but the detachable portion 161*b*1 may be elastically deformed when the hinge portion 163*a* is inserted. That is, the hinge portion 163*a* may be detachably coupled to the support portions 161*b* by the elastic deformation of the detachable portion 161*b*1.

When the hinge portions 163*a* are coupled to the support portions 161*b* and the cleaner 100 of the present invention is operated, the frame 161 may be inserted into the nozzle portion 121 of the suction unit 120, so as to restrict the elastic deformation of the detachable portion 161*b*1. Thus, the separation of the frame 161 and the variable shutter 163 from each other can be prevented.

With the configuration of the detachable portion 161*b*1, the frame 161 and the variable shutter 163 included in the brush assembly 160 of the present invention can be detached by the user's operation, and each component can be easily managed.

Next, a detachable structure between the variable shutter 163 and the brush rotation bar 162 will be described. In this embodiment, the hinge portions 163*a* of the variable shutter 163 may be formed to surround a part of the outer circumferential surface of the brush rotation bar 162. The hinge portions 163*a* and the outer circumferential surface of the brush rotation bar 162 may be slidably brought into contact with each other.

As a result, the outer circumferential surface of the hinge portion 163*a* may be rotatably supported by the support portion 161*b*, as aforementioned, and an inner circumferential surface of the hinge portion 163*a* may be rotatably supported by the outer circumferential surface of the brush rotation bar 162.

In this instance, the shutter portion 163*b* and the pressing portion 163*c* of the variable shutter 163 that connect the hinge portions 163*a* located with being spaced apart from each other may be located at one side with respect to a rotation center for the rotation of the hinge portions 163*a*, for example, at a position lower than the rotation center.

Since the variable shutter 163 may be formed of plastic having a predetermined elastic modulus, the variable shutter 163 may be opened as a gap between the hinge portions 163*a* forming the both ends is widened by the user's pressing force. At this time, since the pressing portion 163*c* and the shutter portion 163*b* are positioned below the rotation center of the hinge portions 163*a*, the gap between the hinge portions 163*a* may be widened in a direction toward an upper side, and thus the brush rotation bar 162 can be inserted into the variable shutter 163 from the upper side. The variable shutter 163 and the brush rotation bar 162 can be easily managed by the detachable structure.

In addition, when the hinge portions 163*a* of the variable shutter 163 are slid on the outer circumferential surface of the brush rotation bar 162 so as to be rotatable thereon, a separate rotating shaft structure for rotation of the variable shutter 163 is not additionally needed. This may minimize a complicated structure due to the addition of the variable shutter 163.

The structure and function of the variable shutter 163 and the features of the detachable structure between the variable shutter 163 and the frame 161 have been described above. Hereinafter, description will be given of an opening stopper 161*d* and a closing stopper 161*e* by which the variable shutter 163 is supported between correct positions when the variable shutter 163 is rotated.

First, referring to FIGS. 6A and 6B, the frame 161 mounted on the brush assembly 160 of the present invention may further include an opening stopper 161*d*. The opening stopper 161*d* is formed to restrict the reverse rotation R' of the directions described above, that is, the rotation of the variable shutter 163 in a direction of opening the opening 161*a*.

In this embodiment, the opening stopper 161*d* may be formed to lock (stop) the shutter portion 163*b*. For example, the opening stopper 161*d* may protrude from at least part of a rear surface of the extending portion 161*c* constituting the frame 161. The opening stopper 161*d* may support the shutter portion 163*b* at a preset position so that the shutter portion 163*b* cannot rotate further upward. This may result in preventing the reverse rotation R' of the hinge portions 163*a* connected to the shutter portion 163*b* and the pressing portion 163*c* at the preset position.

By providing the opening stopper 161*d*, the sectional area of the opening 161*a* can be maintained as a preset value in the general floor section illustrated in FIG. 6A. Further, when the squeegee member 163*c*1 is further provided on the pressing portion 163*c*, the opening stopper 161*d* may prevent the squeegee member 163*c*1 from being further rotated downward at a preset position. This may result in preventing an increase in running resistance or abrasion of the squeegee member 163*c*1 due to the squeegee member 163*c*1 rubbing against the floor.

In this embodiment, the opening stopper 161*d* is formed on the frame 161, but in some cases, may be formed on the nozzle portion 121 of the suction unit so as to restrict the rotation of the shutter portion 163*b* when the brush assembly 160 is mounted.

Next, referring to FIGS. 6A and 6B, the frame 161 mounted to the brush assembly 160 of the present invention may further include a closing stopper 161*e*. The closing stopper 161*e* is formed to restrict the forward rotation F' of the aforementioned directions, that is, the rotation of the variable shutter 163 in a direction of closing the opening 161*a*.

In this embodiment, the closing stopper 161*e* may be formed so as to lock the pressing portion 163*c*. The support portions 161*b* located at the both ends of the frame 161 may be connected to each other by a connecting portion 161*f* at the rear side R as if they are connected to each other by the extending portion 161*c* at the front side F. At this time, the closing stopper 161*e* may protrude from the connecting portion 161*f* so that the pressing portion 163*c* can be stopped without being further upwardly rotated (i.e., forward rotation F') at a preset position. When the pressing portion 163*c* is not rotated upward any more, the hinge portions 163*a* and the shutter portion 163*b* connected to the pressing portion 163*c* are also stopped and the shutter portion 163*b* is not moved downward any more while closing a part of the opening 161*a*.

By providing the closing stopper 161*e*, as illustrated in FIG. 6B, the opening 161*a* can be correctly maintained in a partially closed state in the carpet floor section. At this time, the pressing portion 163*c* may be maintained in the stopped state in a manner of being continuously pressed by the floor with the carpet at the lower side thereof and being locked by the closing stopper 161*e* at the upper side thereof.

Furthermore, similar to the opening stopper 161*d*, the closing stopper 161*e* is not necessarily formed on the frame 161. The closing stopper 161*e*, for example, may be formed on a mounting portion 121*a* which is formed at the rear side R of the nozzle portion 121 to correspond to the connecting portion 161*f*.

As a result, the opening and closing stoppers 161*e* can accurately vary opening and closing regions of the opening 161*a* in the states illustrated in FIGS. 6A and 6B, respectively, and also allow the squeegee member 163*c*1 of the pressing portion 163*c* to be placed at the correct position.

On the other hand, the pressing portion 163*c* which is stopped by the closing stopper 161*e* may include an elastic member 163*c*2 that is brought into direct contact with the closing stopper 161*e*. The elastic member 163*c*2 serves to apply restoring force to cause a rotation in a direction of increasing the sectional area of the opening 161*a*, namely, the reverse rotation R' of the variable shutter 163.

The elastic member 163*c*2 may be pressed by the contact with the closing stopper 161*e* so as to be elastically deformed. The elastic member 163*c*2 may be made of a rubber material or the like, and may have a hollow cylindrical shape as illustrated in FIGS. 2, 6A and 6B. The elastic member 163*c*2 may be mounted in a manner that a part of an outer circumferential surface thereof is brought into contact with an accommodating portion 163*c*3 formed on the pressing portion 163*c*.

The remaining part of the elastic member 163*c*2 may be pressed by the closing stopper 161*e* to generate elastic force when the pressing portion 163*c* is rotated upward. The generated elastic force is applied to rotate the pressing portion 163*c* downward. When the pressing force by the floor disappears, the pressing portion 163*c* may be fast moved downward by the elastic force.

The forward rotation F' of the variable shutter 163 according to the present invention is caused by the pressing of the floor, which may enable an instant operation. Here, when the elastic member 163*c*2 is added, the reverse rotation R' of the variable shutter 163 from the state of FIG. 6B to the state of FIG. 6A can be performed fast. Therefore, reliability of the operation of the variable shutter 163 of the present invention can be improved by the elastic member 163*c*2.

On the other hand, as illustrated in FIGS. 6A and 6B, the elastic member 163*c*2 may be formed integrally with the squeegee member 163*c*1. The elastic member 163*c*2 and the squeegee member 163*c*1 integrally formed with each other may be mounted in the accommodating portion 163*c*3 of the pressing portion 163*c*.

To this end, the accommodating portion 163*c*3 may have a concave-convex shape including a concave portion 163*c*3' and a convex portion 163*c*3". The elastic member 163*c*2 is accommodated in the concave portion 163*c*3' of the accommodating portion 163*c*3 in a manner that its upper side is exposed, so as to be contactable with the closing stopper 161*e*. The squeegee member 163*c*1 may be connected to the elastic member 163*c*2 in a manner of surrounding the convex portion 163*c*3" of the accommodating portion 163*c*3, and protrude downward to catch (lock) foreign substances on the floor.

As described in this embodiment, when the elastic member 163*c*2 and the squeegee member 163*c*1 are integrally formed, the structure of the variable shutter 163 of the present invention having various functions can be realized more simply. In addition, the elastic member 163*c*2 and the squeegee member 163*c*1 can be made of the same material such as rubber or the like, and fabrication and assembly thereof can be more facilitated.

The pressing portion 163*c* of the variable shutter 163 of the present invention may further include a mass reinforcing portion to assist the reverse rotation R' of the variable shutter 163, similar to the elastic member 163*c*2. The mass reinforcing portion is made to further strengthen a torque for restoring the variable shutter 163 from the state of FIG. 6B to the state of FIG. 6A.

The mass reinforcing portion may be formed at the rear R of the hinge portion 163*a* with being spaced apart in a radial direction from the rotation center formed by the hinge portion 163*a*. For example, the mass reinforcing portion may be formed on the pressing portion 163*c*. The mass reinforcing portion may be formed to have a material having relatively high density or have a thickness greater than that of the other portion of the variable shutter 163, so as to further add a preset mass.

By the mass reinforcing portion, the operation that the variable shutter 163 increases the height of the opening 161*a* to be suitable for the general floor can be fast performed. Furthermore, when the squeegee member 163*c*1 is provided on the pressing portion 163*c*, the squeegee member 163*c*1 can be prevented from being shaken or pushed up by foreign materials to a certain level.

In addition, for convenience in fabricating the variable shutter 163 provided in the present invention, the mass reinforcing portion may be the accommodating portion 163*c*3. In other words, the mass reinforcing portion may be formed to accommodate the squeegee member 163*c*1 or the elastic member 163*c*2, and thus can perform the role of the accommodating portion 163*c*3. In this case, the elastic member 163*c*2, the squeegee member 163*c*1, and the mass reinforcing portion described above can be integrally formed as illustrated in FIGS. 6A and 6B. Therefore, various functions of the pressing portion 163*c* or the variable shutter 163 described above can be achieved by a simple structure.

The foregoing embodiments are merely given of those embodiments for practicing the cleaner 100 according to the present invention. Therefore, the present invention is not limited to the above-described embodiments, and it will be understood by those of ordinary skill in the art that various changes in form and details may be made therein without departing from the scope of the present invention.

What is claimed is:

1. A cleaner, comprising:

a cleaner main body; and a suction unit provided with a nozzle portion configured to receive air containing foreign substances on a floor into the cleaner main body, and a brush assembly detachably mounted on the nozzle portion, wherein the brush assembly includes:

a frame coupled to the nozzle portion, the frame including an extending portion extending in a direction parallel to a brush rotation bar and spaced apart from the floor to form an opening between the floor and the extending portion, and support portions connected to two ends of the extending portion;

the brush rotation bar accommodated in the frame and having at least one end portion rotatably supported on the frame; and a variable shutter rotatably mounted on the frame, wherein the variable shutter includes:

a pressing portion provided behind a rotation axis of the brush rotation bar, wherein a lower end of the pressing portion protrudes toward the floor; and a shutter portion provided in front of the rotation axis of the brush rotation bar and configured to close or open a part of the opening by a rotating thereof, wherein a lower end of the shutter portion is positioned higher than the lower end of the pressing portion with respect to the floor, wherein the variable shutter is rotated about a same axis as the rotation axis of the brush rotation bar, and wherein, when the pressing portion is pressed by contacting the floor, the lower end of the pressing portion is received in the frame, and the shutter portion is rotated in a same direction as the brush rotation bar to partially close the opening between a front and a lower side of the brush rotation bar.

2. The cleaner of claim 1, wherein the variable shutter further includes:

hinge portions rotatably mounted on two ends of the frame, and wherein:

the pressing portion is connected to rear regions of the hinge portions and configured to transfer rotational force to the hinge portions such that the hinge portions rotate in in a first circumferential direction when the pressing portion is rotated upward in response to contact with the floor, and the shutter portion is connected to front regions of the hinge portions and configured to be rotated downward to close the part of the opening based on the hinge portions rotating in the first circumferential direction.

3. The cleaner of claim 2, wherein the pressing portion is provided with a squeegee that extends parallel with the brush rotation bar so as to restrict movement of foreign substances rear of the brush rotation bar.

4. The cleaner of claim 2, wherein the support portions are configured to rotatably support the hinge portions.

5. The cleaner of claim 4, wherein one of the support portions is provided with a detachable portion that is opened at an upper side.

6. The cleaner of claim 2, wherein each of the hinge portions surrounds an end of the brush rotation bar so as to be slid on an outer circumferential surface of the brush rotation bar.

7. The cleaner of claim 6, wherein the lower end of the shutter portion and the lower end of the pressing portion are located lower than a rotation center of the hinge portions.

8. The cleaner of claim 1, wherein the frame is provided with an opening stopper protruding toward a rotation path of the shutter portion so as to restrict an upward rotation of the variable shutter.

9. The cleaner of claim 1, wherein the frame is provided with a closing stopper protruding toward a rotation path of the pressing portion so as to restrict the upward rotation of the pressing portion.

10. The cleaner of claim 9, wherein the pressing portion includes an elastic member configured to be deformed elastically when brought into contact with the closing stopper and configured to generate a force in a direction away from the closing stopper in order to return to an original state from being deformed, and wherein a direction in which the pressing portion is rotated by contact with the floor corresponds to a rotation direction of the brush rotation bar.

11. The cleaner of claim 9, wherein the pressing portion is provided with a squeegee that extends parallel with the brush rotation bar so as to restrict movement of foreign substances rear of the brush rotation bar.

12. The cleaner of claim 1, wherein the pressing portion is provided with a mass reinforcing portion configured to apply a torque for rotating the variable shutter in a downward direction to open the opening.

13. The cleaner of claim 12, wherein the pressing portion is provided with a squeegee that extends parallel with the brush rotation bar so as to restrict movement of foreign substances rear of the brush rotation bar, and wherein the squeegee is inserted into the mass reinforcing portion.

14. A cleaner, comprising:

a main body; and a cleaning head having a roller to clean a surface;

a frame received in the cleaning head and including:

ends to rotatably receive the roller, and a bar that extends parallel to the roller and between the ends, the bar having an opening; and a shutter rotatably mounted on the frame and including:

hinge plates rotatably coupled to the ends of the frame, a rear extension that is coupled to a first region of the hinge plates that is positioned rearward of a rotational axis of the roller, a lower end of the rear extension protruding toward the floor, and a front extension that extends parallel to the roller and is coupled to a second region of the hinge plates that is positioned between the bar and the rotational axis of the roller, wherein:

the shutter is rotated about a same axis as the rotational axis of the roller, the rear extension is rotated in a same direction as a rotational direction of the roller and the lower end of the rear extension is received in the frame when the lower end of the rear extension is brought into contact with a cleaning surface, the hinge plates rotate in a first circumferential direction when the rear extension is rotated in the same direction as the rotational direction of the roller, and the front extension is rotated in the same direction as the rotational direction of the roller to partially close the opening when the hinge plates rotate in the first circumferential direction.

15. The cleaner of claim 14, wherein the rear extension includes rear plate that extends parallel with the roller to contact the floor.

16. The cleaner of claim 14, wherein the frame further includes supports that are rotatably coupled to the hinge plates, wherein one of the supports is opened at an upper region.

17. The cleaner of claim 14, wherein a lower end of the front extension and the lower end of the rear extension are located lower than a rotational center of the hinge plates.

18. The cleaner of claim 14, wherein the frame further includes a first stopper protruding toward a rotation path of the front extension so as to limit a rotation of the shutter in a second circumferential direction that is opposite to the first circumferential direction.

19. The cleaner of claim 18, wherein the frame further includes a second stopper protruding toward a rotation path of the rear extension so as to restrict a rotation of the shutter in the first circumferential direction.

20. The cleaner of claim 14, wherein the rear extension moves upward when the cleaner is used on carpeting.

* * * * *